US009239160B1

(12) United States Patent
Wang et al.

(10) Patent No.: US 9,239,160 B1
(45) Date of Patent: Jan. 19, 2016

(54) COOLED LED LIGHTING APPARATUS

(71) Applicant: CLEDOS green tech Limited, Hong Kong (HK)

(72) Inventors: James Wang, Hong Kong (HK); Kei May Lau, Hong Kong (HK); Parco Wang, Hong Kong (HK); Terence Cho, Hong Kong (HK); Zhaojun Liu, Hong Kong (HK); Eddie Chong, Hong Kong (HK)

(73) Assignee: CLEDOS GREEN TECH LIMITED, Hong Kong (HK)

( * ) Notice: Subject to any disclaimer, the term of this patent is extended or adjusted under 35 U.S.C. 154(b) by 19 days.

(21) Appl. No.: 14/468,158

(22) Filed: Aug. 25, 2014

(51) Int. Cl.

| | |
|---|---|
| ***F21V 29/00*** | (2015.01) |
| ***F21V 29/83*** | (2015.01) |
| ***F21V 29/58*** | (2015.01) |
| ***F21V 29/67*** | (2015.01) |
| ***F21V 29/65*** | (2015.01) |
| ***F21S 4/00*** | (2006.01) |
| *F21Y 105/00* | (2006.01) |

(52) U.S. Cl.
CPC ..... *F21V 29/83* (2015.01); *F21S 4/008* (2013.01); *F21V 29/59* (2015.01); *F21V 29/65* (2015.01); *F21V 29/67* (2015.01); *F21Y 2105/001* (2013.01)

(58) Field of Classification Search
CPC ..... F21V 29/56; F21V 29/59; F21V 29/60; F21V 29/65; F21V 29/67; F21V 29/503; F21S 4/008
See application file for complete search history.

(56) References Cited

U.S. PATENT DOCUMENTS

| | | | | |
|---|---|---|---|---|
| 2005/0128752 | A1* | 6/2005 | Ewington et al. | F21V 29/89 362/294 |
| 2011/0156584 | A1* | 6/2011 | Kim | F21K 9/00 315/32 |
| 2012/0300475 | A1* | 11/2012 | Kim | F21V 29/02 362/373 |

* cited by examiner

*Primary Examiner* — Thomas M Sember
(74) *Attorney, Agent, or Firm* — Venture Pacific Law, PC

(57) ABSTRACT

A light emitting diode ("LED") lighting apparatus has vents to cool the LED lighting apparatus. The LED lighting apparatus comprises one or more strips, a base having vents, and one or more glass tubes. Each strip has LEDs and a transparent backing. The vents comprise a central vent and side vents, were the central vent and certain ones of the side vents are connected to allow for gas flow. The one or more strips and the one or more glass tubes are coupled to the base, where the one or more glass tubes encapsulate the one or more strips. The central vent is disposed adjacent to the one or more glass tubes, and a heat transfer medium within selected ones of the one or more glass tubes flows out of the selected ones of the one or more glass tubes for cooling.

12 Claims, 7 Drawing Sheets

COOLED LED LIGHTING APPARATUS

FIELD OF INVENTION

The disclosure relates to methods, systems, and apparatuses for light emitting diode lighting, and, more particularly, to methods, systems, and apparatuses for cooling light emitting diodes.

BACKGROUND

A light emitting diode ("LED") is a semiconductor light source, which has a longer lifetime, faster switching, smaller physical size, greater durability and higher energy efficiency than current day lighting devices, e.g., fluorescent lights bulbs or incandescent light bulbs. When an LED is forward biased, electrons (negative charges) recombine with holes (positive charges), releasing energy in the form of photons. The energy difference between the electrons and holes of the LED produces photons of different wavelengths. Certain wavelengths provide for specific visible colors. Thus, the LED does not require color filters to produce any specific colors.

Generally, LEDs are solid state devices, and if operated at low currents and at low temperatures, are subject to limited device wear and tear. Lifetimes of LEDs are anywhere from around five to fifty times longer than fluorescent light bulbs and incandescent light bulbs. LEDs are also less susceptible to damage than fluorescent and incandescent light bulbs.

LEDs produce more light per watt than incandescent bulbs, and are ideal for use in applications that are subject to frequent on-off cycling, unlike fluorescent lamps that burn out more quickly when cycled frequently. LEDs can very easily be dimmed continuously unlike fluorescent lamps which require a certain threshold voltage to maintain illumination.

LEDs have been found to have significant environmental benefits compared to other alternatives. For instance, a building's carbon footprint from lighting can be significantly reduced by exchanging all incandescent bulbs for LED light bulbs. LEDs are also non-toxic compared to fluorescent light bulbs, which contain traces of mercury.

Performance of LEDs is temperature dependent, and LED light output can actually increase at lower temperatures. LEDs do not generate as much heat as incandescent bulbs, but LEDs do produce internal heat which must be dissipated if the LED is to maintain good performance and low temperatures. Conversely, over-heating LEDs can lead to major device failure.

In order to combat overheating of LEDs, LED lights have incorporated heat sinks to dissipate heat generated by the LEDs. Heat sinks are widely available for LEDs, but any improvement in cooling can increase device operations and reliability. Some heat sinks are made by simply having a number of cooling fins connected to the LEDs. However, these designs are bulky, aesthetically unpleasing, and expensive to build LED light bulbs.

Therefore, it is desirable to develop new methods, systems, and apparatuses for cooling LED lighting (e.g., LED light bulbs, LED lamps, and other LED lighting apparatuses) to increase performance and maintain a long lifespan for the LEDs.

SUMMARY OF INVENTION

Briefly, the disclosure relates to a light emitting diode ("LED") lighting apparatus, comprising: one or more strips, wherein each of the one or more strips has LEDs and a transparent backing; a base having vents, wherein the vents comprise a central vent and side vents and wherein the central vent and certain ones of the side vents are connected to allow for gas flow; and one or more glass tubes, wherein the one or more strips and the one or more glass tubes are coupled to the base, wherein the one or more glass tubes encapsulate the one or more strips, wherein the central vent is disposed adjacent to the one or more glass tubes, and wherein a heat transfer medium within selected ones of the one or more glass tubes flows out of the selected ones of the one or more glass tubes for cooling.

DESCRIPTION OF THE DRAWINGS

The foregoing and other aspects of the disclosure can be better understood from the following detailed description of the embodiments when taken in conjunction with the accompanying drawings.

DETAILED DESCRIPTION OF THE EMBODIMENTS

In the following detailed description of the embodiments, reference is made to the accompanying drawings, which form a part hereof, and in which is shown by way of illustration of specific embodiments in which the disclosure may be practiced.

Figure 1:
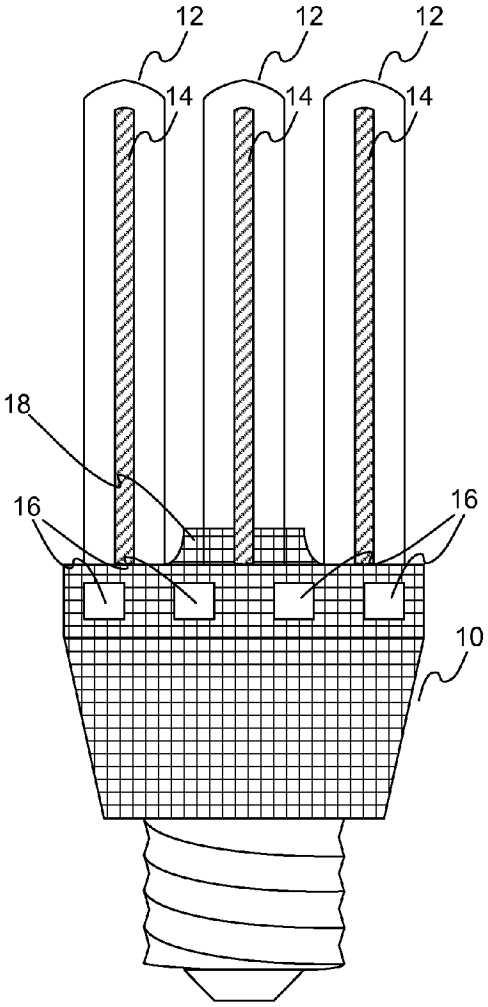
FIG. 1 illustrates a side view of an LED lighting apparatus having vents to cool the LEDs.

FIG. 1 illustrates a side view of a light emitting diode ("LED") lighting apparatus having vents to cool the LEDs. An LED lighting apparatus comprises a base 10, LED strips 14, and glass tubes 12 that encapsulate the LED strips 14. The base 10 has vents 16 and 18 to allow gas (or other heat transfer medium, including air, liquid, etc.) flow through the base 10 from one side of the base 10 to another side of the base 10 or to within the glass tubes 12. The LED strips 14 comprise LEDs interconnected to a backing, where the backing is coupled to the base 10. The coupling can be by mechanical interlocking means, soldering, or by other coupling means. The base 10 is electrically connected to the LED such that the base 10 can receive an input voltage and drive the LEDs of the LED strips 14. For instance, the base 10 can be screwed into a light socket, where the light socket provides a voltage that is routed to the LED strips 14 via the base 10. It is understood by a person having ordinary skill in the art that the LED lighting apparatus can have electrical components to receive an input voltage and drive the LEDs of the LED strips 14. For instance, the base 10 may have well known circuitry to boost, rectify, regulate, and/or otherwise alter the voltage from the light socket before being inputted to the LED strips 14. A person having ordinary skill in the art is aware of such circuitry. Thus, the present disclosure also includes such electrical circuitry to operate the LED lighting apparatus.

When the LED strips 14 are activated, i.e., the LEDs are on, heat is generated. The generated heat is transferred to the glass tubes 12. The gas flow through vents 16 and 18 of the base 10 can be directed along the glass tubes 12 to cool the glass tubes 12. Thereby, the LED strips 14 can be cooled by using the glass tubes 12 to transfer the heat away from the LED strips 14. The vents 16 and 18 are bidirectional in that gas can flow either into the vent or out of the vent. The side vents 16 are located at the sides of the base 10 and away from the LED strips 14. The central vent 18 is located in between the LED strips 14. The gas near the side vents 16 are generally cooler than the gas near the central vent 18 since the LED strips 14 generate heat and are closer to the central vent 18. The central vent 18 can be connected to the side vents 16 such that the gas near the side vents 16 can be directed and expelled through the central vent 18 or gas near the central vent 18 can be directed and expelled through the side vents 16. Furthermore, a fan (not shown and an optional component) can be located in the base 10 along the gas flow to increase gas flow through the vents 16 and 18.

In an example, as the gas between the glass tubes 12 is heated up, cooler gas near the side vents 16 can travel through the base 10 and out through the central vent 18 to circulate out the heated gas and to cool the exterior walls of the glass tubes 12. Conversely, depending on the orientation of the LED lighting apparatus, the heated gas can travel through the central vent 18 and out to the side vents 16 to allow for cooler gas to circulate across the glass tubes 12.

In another example, certain ones of the vents 16 can be connected directly to the encapsulated portions of the glass tubes 12. In his manner, a heat transfer medium, e.g., gas, can circulate from outside the LED lighting apparatus to the encapsulated portions of the glass tubes 12. Also, the heat transfer medium within the encapsulated portions of the glass tubes 12 can be expelled out of the glass tubes with a cooler heat transfer medium being circulated into the glass tubes 12.

In yet another example, the heat transfer medium can be liquid. Here, certain ones of the glass tubes 12 can contain liquid to increase the heat transfer from the LEDs of the LED strips 14 to the glass tubes 12. Furthermore, a liquid cooling unit (not shown and an optional component) can be disposed in the base 10 to further cool the liquid within the glass tubes 12. The liquid within the encapsulated portions of the glass tubes 12 can be expelled out of the glass tubes to the liquid cooling unit to be cooled, and then the cooled liquid can be recirculated back into the glass tubes 12.

Figure 2:
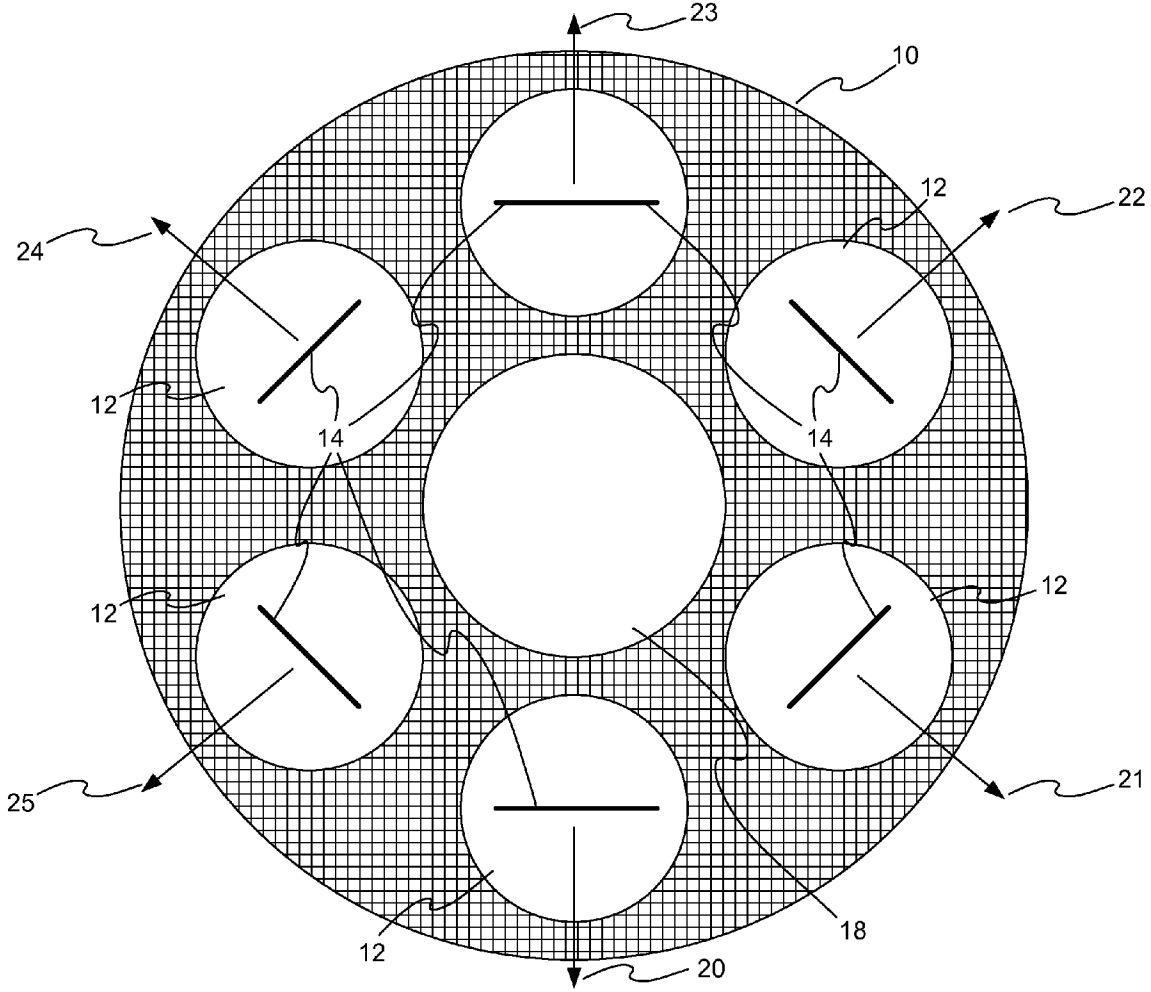
FIG. 2 illustrates a top view of an LED lighting apparatus having a central vent.

FIG. 2 illustrates a top view of an LED lighting apparatus having a central vent. In a top view, the central vent 18 can be located in between the glass tubes 12. The LED strips 14 within the glass tubes 12 can be positioned such that the LED strips 14 have LEDs facing in different directions, e.g., directions 20-25, to increase the light distribution from the LED lighting apparatus. The backing on the LED strips can also be transparent such that the LEDs can emit light in the directions 20-25 and opposite directions relative to the directions 20-25.

Figure 3A:
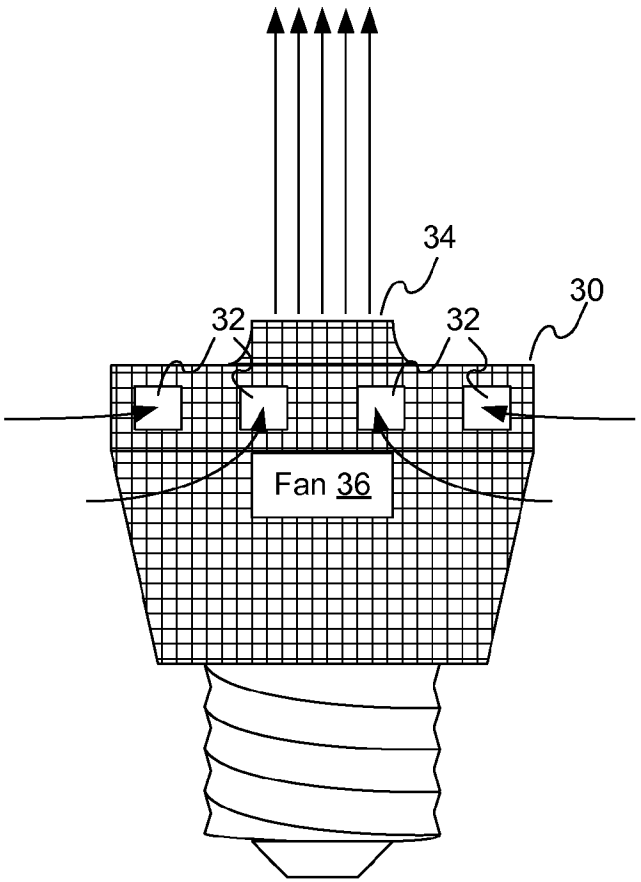
FIGS. 3*a*-3*b* illustrate side views of a base of an LED lighting apparatus having a central vent and side vents.
Figure 3B:
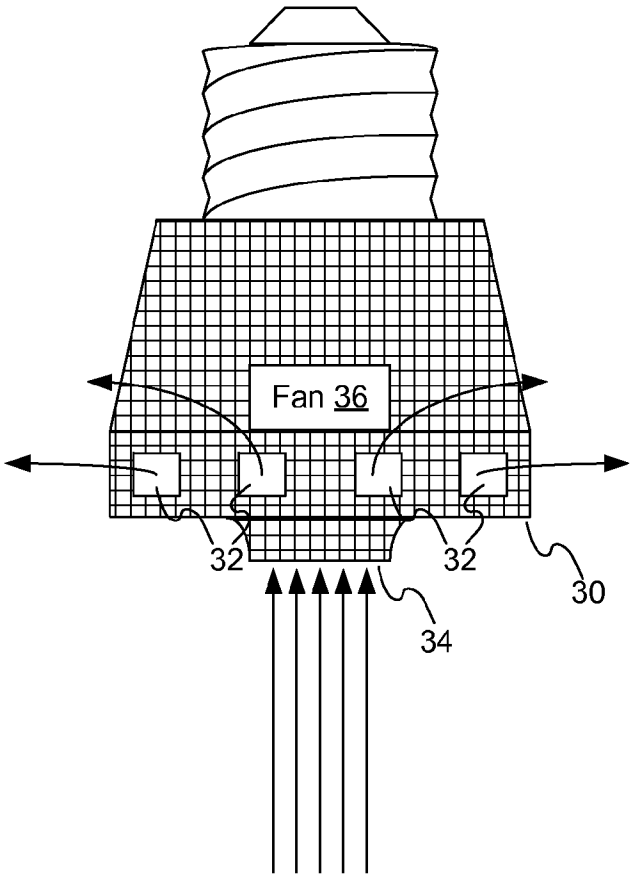

FIGS. 3*a*-3*b* illustrate side views of a base of an LED lighting apparatus having a central vent and side vents.

FIG. 3*a* illustrates the base of the LED lighting apparatus positioned in an upward orientation. The LED lighting apparatus is illustrated without glass tubes and LED strips in order to emphasize gas flow through a base 30 of the LED lighting apparatus. However, the present disclosure is not limited by this figure since it is understood that any number of glass tubes and LED strips can be coupled to the base 30.

The base 30 can have vents 32 and 34 and a fan 36 to promote gas flow. Depending on the environmental conditions near the LED lighting apparatus (e.g., the direction of gravity, ambient temperature(s), and/or other environmental conditions) and the fan's blowing direction, heated gas can flow upwards with cooler gasses from the side vents 32 entering the base 30 and circulating to the central vent 34. This orientation can be referred to as an upward orientation of the LED lighting apparatus. The fan 36 can increase the gas flow through the vents 32 and 34 by pumping additional gas up through the central vent 34.

FIG. 3*b* illustrates the base of the LED lighting apparatus positioned in a downward orientation. In another example, the orientation of the LED lighting apparatus can be positioned such that the heated gas can circulate through the central vent 34 and out the side vents 32. This orientation can be referred to as a downward orientation. The fan 36 can also aid in the gas flow by pumping the heated gas from the central vent 34 to be expelled by the side vents 32.

Figure 4:
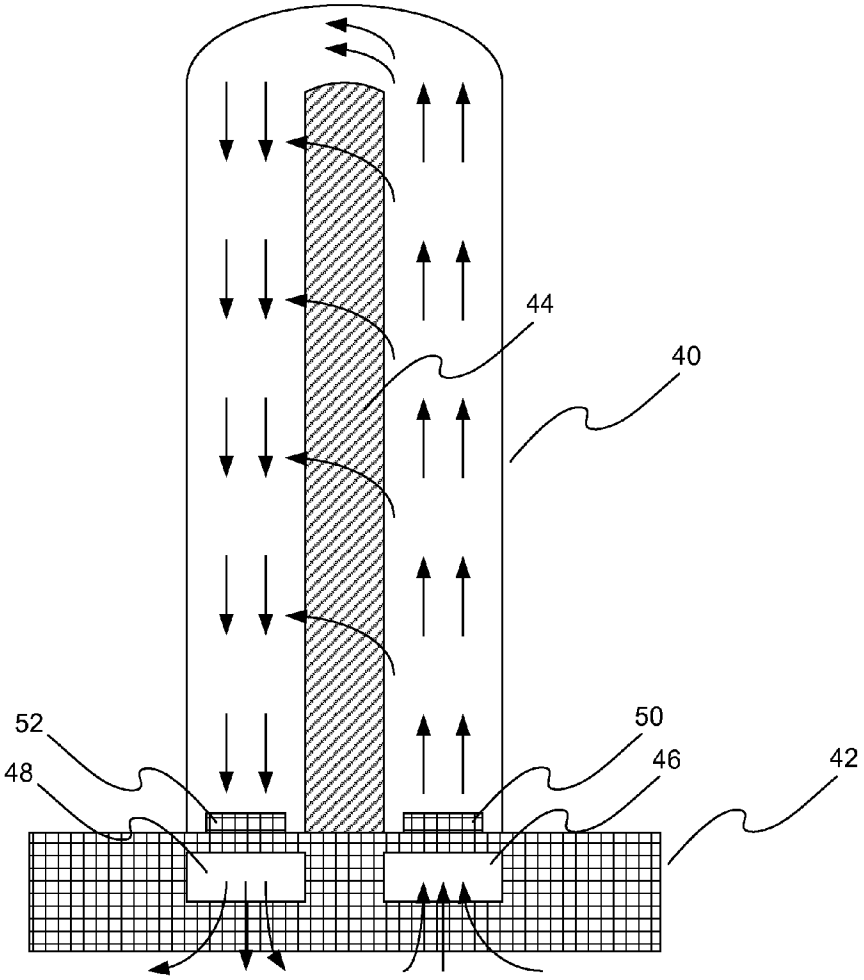
FIG. 4 illustrates an LED lighting apparatus using gas cooling.

FIG. 4 illustrates an LED lighting apparatus using gas cooling. An LED lighting apparatus comprises a base 42 having vents 46-52, a glass tube 40, and an LED strip 44. The glass tube 40 is coupled to the base 42, encapsulating the LED strip 44 within the glass tube 40. The vent 46 allows gas to enter the base 42 and enter the glass tube 40 via the internal vent 50. The vent 48 allows gas within the glass tube 40 to be expelled via the internal vent 52. In order to aid in the understanding of the present disclosure, a single glass tube and a single LED strip are shown. This is not meant to limit the present disclosure. In fact, it is understood that the LED lighting apparatus may have additional vents, glass tubes, LED strips, and/or use one or more cooling methods as desired.

The gas within the glass tube 40 can be circulated to the outside of the LED lighting apparatus via the vents 48 and 52. Cooler gas can be circulated from the outside area relative to the LED lighting apparatus to inside the glass tube 40 via the vents 46 and 50. In particular, the vents 52 and 48 are connected such that gas can flow into one vent and out the other vent. The vents 46 and 50 are also connected such that gas can flow into one vent and out the other vent. Furthermore, the vents 46-52 are bidirectional. Thus, the reverse gas flow for each pair of vents can also occur.

In one scenario, gas can flow into vent 46, and then into the glass tube 40 via the internal vent 50. The gas inside the glass tube 40 can flow out at the vent 48 via the vent 52. It is important to note that additional vents can be used based on the present disclosure. Therefore, the present illustration is not meant to limit the present disclosure to two vents for each of the glass tubes. In fact, it is understood by a person having ordinary skill in the art that additional vents can be added to increase gas flow to and out of the glass tube. The LED lighting apparatus using gas cooling can also comprise other methods for cooling the LEDs, including those described in the present disclosure.

Figure 5:
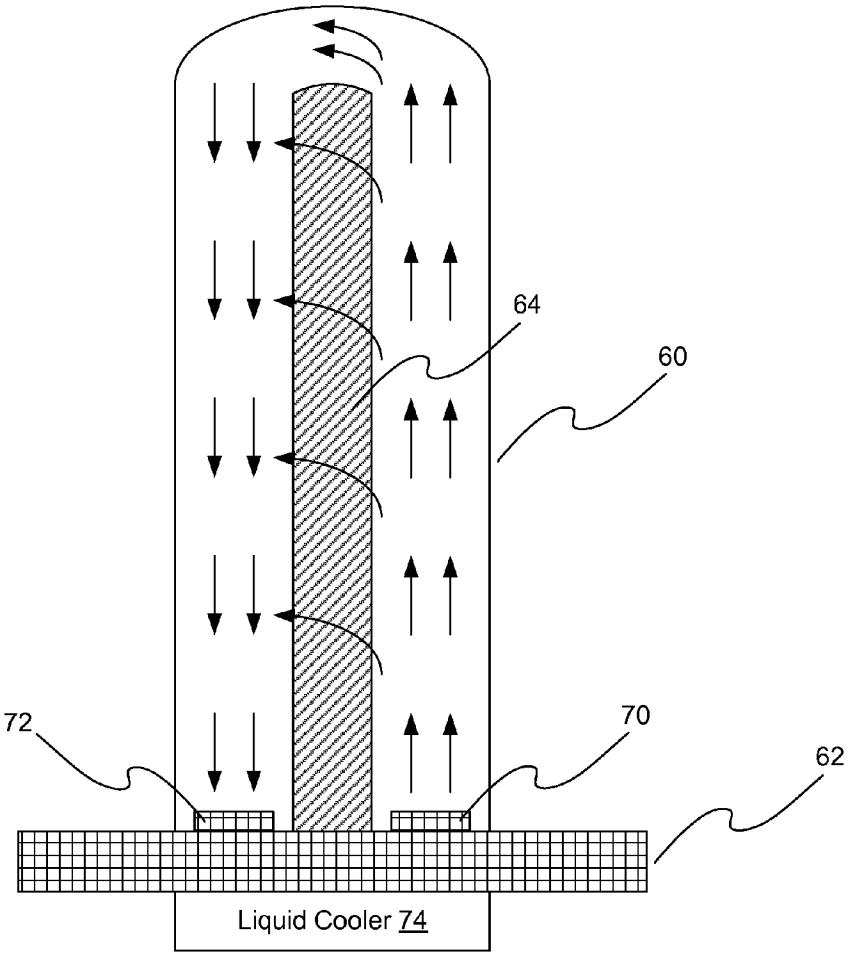
FIG. 5 illustrates an LED lighting apparatus using liquid cooling.

FIG. 5 illustrates an LED lighting apparatus using liquid cooling. An LED lighting apparatus comprises a base 62 having vents 70-72, a glass tube 60, an LED strip 64, and a liquid cooling unit 74. The glass tube 60 is coupled to the base 62, encapsulating the LED strip 64 within the glass tube 60. The vent 70 allows liquid to flow into the glass tube 40. The vent 72 allows the liquid within the glass tube 40 to be expelled. The expelled liquid can be cooled by the liquid cooling unit 74. The cooled liquid is connected to the vent 70 for returning back into the glass tube 70. In this manner, heat can be dissipated from the LED strip 64 by circulating the cooled liquid from the liquid cooling unit 74. In order to aid in the understanding of the present disclosure, a single glass tube and a single LED strip are shown. This is not meant to limit the present disclosure. In fact, it is understood that the LED lighting apparatus may have additional vents, glass tubes, and LED strips as desired.

The vents 70-72 are bidirectional. Thus, the reverse liquid flow for the pair of vents can also occur. For instance, liquid can flow out the vent 72 to the liquid cooling unit 74 to be cooled. The cooled liquid is circulated back into the glass tube 40 via the vent 70. It is important to note that additional vents can be used based on the present disclosure. Therefore, the present illustration is not meant to limit the present disclosure to two vents for each of the glass tubes. In fact, it is understood by a person having ordinary skill in the art that additional vents can be added to increase liquid flow to and out of the glass tube. The LED lighting apparatus using liquid cooling can also comprise other methods for cooling the LEDs, including those described in the present disclosure.

The liquid can be pigmented to allow for a colored indicator to indicate the temperature of the LEDs of the LED lighting apparatus. For instance, the liquid can be colored various shades of yellow to indicate a relative temperature for the LEDs of the LED lighting apparatus.

The liquid can also be pigmented to change the emitted color of the LED lighting apparatus to approximate one or more predefined colors. For instance, if the LED strip emits a blue-ish light, the liquid can have a yellowish pigment to give a warmer yellow color to the emitted light. Furthermore, the emitted light can be strobed between various colors by altering the pigments in the liquid.

Figure 6:
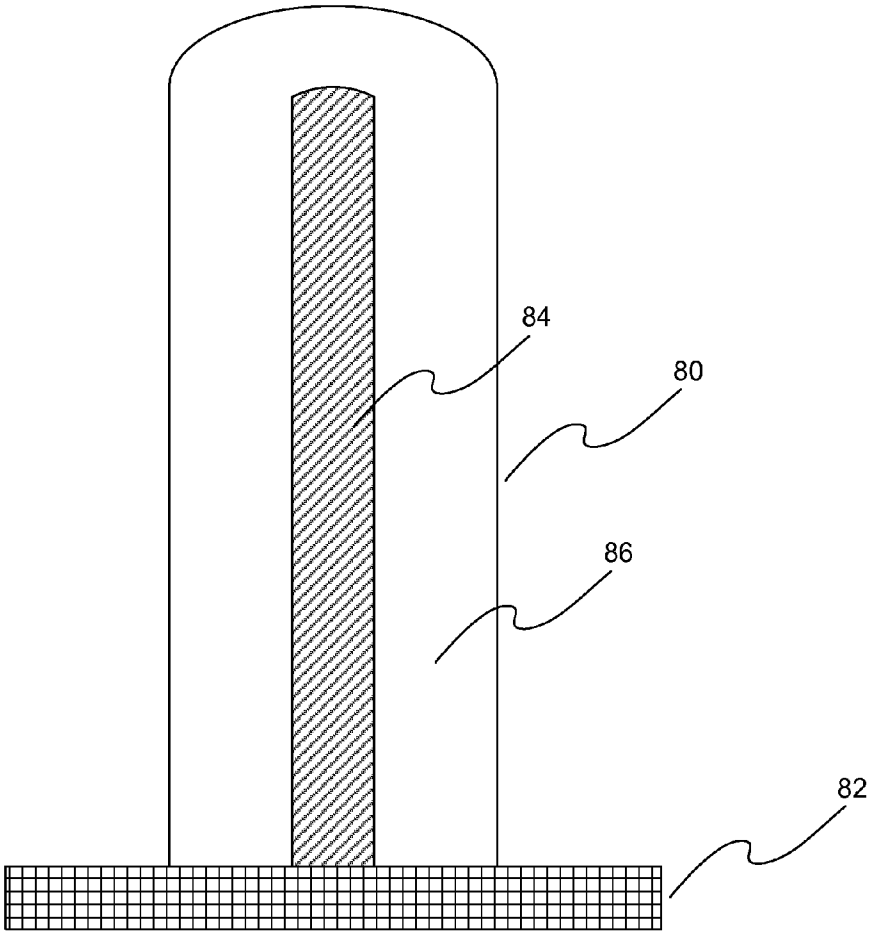
FIG. 6 illustrates an LED lighting apparatus using compressed gas for cooling an LED lighting apparatus.

FIG. 6 illustrates an LED lighting apparatus using compressed gas for cooling an LED lighting apparatus. In another embodiment, an LED lighting apparatus comprises a base 82, a glass tube 80, an LED strip 84, and compressed air 86. The compressed air 86 can serve to increase the heat transfer between the LEDs of the LED strip 84 and the glass tube 80. The LED lighting apparatus using compressed gas for cooling the LEDs can also comprise other methods for cooling LEDs, including those described in the present disclosure.

In various embodiments of the present invention, various combinations of cooling methods can be used together in the same lighting apparatus. Referring to FIG. 2 as an example, two of the glass tubes 14 can use a gas cooling method of the present disclosure, two other ones of the glass tubes 14 can use a compressed gas method of the present disclosure, and the remaining two glass tubes 14 can use a liquid cooling method of the present disclosure. Furthermore, combinations thereof the cooling methods of the present disclosure can be used as well.

While the disclosure has been described with reference to certain embodiments, it is to be understood that the disclosure is not limited to such embodiments. Rather, the disclosure should be understood and construed in its broadest meaning, as reflected by the following claims. Thus, these claims are to be understood as incorporating not only the apparatuses, methods, and systems described herein, but all those other and further alterations and modifications as would be apparent to those of ordinary skilled in the art.

We claim:

1. A light emitting diode ("LED") lighting apparatus, comprising:

one or more strips, wherein each of the one or more strips has LEDs and a transparent backing;

a base having vents, wherein the vents comprise a central vent and side vents and wherein the central vent and certain ones of the side vents are connected to allow for gas flow; and one or more glass tubes, wherein the one or more strips and the one or more glass tubes are coupled to the base, wherein the one or more glass tubes encapsulate the one or more strips in a heat transfer medium, and wherein the central vent is disposed adjacent to the one or more glass tubes.

2. The LED lighting apparatus of claim 1 wherein the heat transfer medium is gas, and wherein the gas circulates via select ones of the side vents.

3. The LED lighting apparatus of claim 1 wherein the heat transfer medium is a liquid.

4. The LED lighting apparatus of claim 3 further comprising a liquid cooling unit, wherein the liquid is circulated to the liquid cooling unit for cooling, and wherein the cooled liquid is recirculated to the one or more glass tubes.

5. The LED lighting apparatus of claim 1 wherein the heat transfer medium is compressed air.

6. The LED lighting apparatus of claim 1 further comprising a fan, and wherein the fan drives gas through the central vent.

7. A light emitting diode ("LED") light bulb, comprising:

one or more strips, wherein each of the one or more strips has LEDs and a transparent backing;

a base having vents, wherein the vents comprise a central vent and side vents and wherein the central vent and certain ones of the side vents are connected to allow for gas flow;

one or more glass tubes; and a fan, wherein the one or more strips and the one or more glass tubes are coupled to the base, wherein the one or more glass tubes encapsulate the one or more strips in a heat transfer medium, wherein the central vent is disposed adjacent to the one or more glass tubes, wherein the fan drives gas flow from the certain ones of the side vents to the central vent, and wherein the gas flow from the central vent circulates adjacent to the one or more glass tubes.

8. The LED lighting apparatus of claim 7 wherein the heat transfer medium is gas, and wherein the gas circulates via select ones of the side vents.

9. The LED lighting apparatus of claim 7 wherein the heat transfer medium is a liquid.

10. The LED lighting apparatus of claim 9 further comprising a liquid cooling unit, wherein the liquid is circulated to the liquid cooling unit for cooling, and wherein the cooled liquid is recirculated to the one or more glass tubes.

11. The LED lighting apparatus of claim 7 wherein the heat transfer medium is compressed air.

12. A light emitting diode ("LED") lighting apparatus, comprising:

one or more strips, wherein each of the one or more strips has LEDs and a transparent backing;

a base having vents, wherein the vents comprise a central vent and side vents and wherein the central vent and certain ones of the side vents are connected to allow for gas flow;

one or more glass tubes;

a fan; and a liquid cooling unit, wherein the one or more strips and the one or more glass tubes are coupled to the base, wherein the one or more glass tubes encapsulate the one or more strips in a liquid, wherein the central vent is disposed adjacent to the one or more glass tubes, wherein the liquid is circulated to the liquid cooling unit for cooling, wherein the cooled liquid is recirculated to the one or more glass tubes, wherein the fan drives gas flow from the certain ones of the side vents to the central vent, and wherein the gas flow from the central vent circulates adjacent to the one or more glass tubes.

* * * * *